US005811745A

United States Patent [19]

Hung

[11] Patent Number: 5,811,745

[45] Date of Patent: Sep. 22, 1998

[54] THREE-WAY SWITCH

[76] Inventor: Wen-Hui Hung, 2F, No. 98, Lane, 1, Sec. 2, Chung San Road, Pan Chiao City, Taipei Hsien, Taiwan

[21] Appl. No.: 819,993

[22] Filed: Mar. 18, 1997

[51] Int. Cl.[6] ..... H01H 19/58; H01R 19/00

[52] U.S. Cl. ..... 200/11 R; 200/11 G; 200/51.06

[58] Field of Search ..... 200/11 R, 11 G, 200/51.03, 51.05, 51.06, 284

[56] References Cited

U.S. PATENT DOCUMENTS

| | | | |
|---|---|---|---|
| 2,799,743 | 6/1957 | Popp | 200/51.03 |
| 3,062,986 | 8/1962 | Fritz et al. | 315/200 |
| 3,143,609 | 8/1964 | Fouts | 200/51.14 |
| 4,012,608 | 3/1977 | Lockard | 200/16 D |
| 4,283,107 | 8/1981 | Anthony | 339/147 R |
| 5,113,044 | 5/1992 | Tomberlin | 200/51.04 |
| 5,581,059 | 12/1996 | Chang | 200/11 G |

*Primary Examiner*—Michael L. Gellner
*Assistant Examiner*—Michael J Hayes
*Attorney, Agent, or Firm*—Browdy and Neimark

[57] ABSTRACT

A three-way switch is composed of a base, an amature member, at least three conductive pieces, and a diode. The base is provided with a receiving space for housing the amature member, the conductive pieces, and the diode. The amature member is fastened with a bridging conductive member such that the armature member is provided with a plurality of bridging portions and an insulation portion, which are in contact with the contact ends of the conductive pieces. The first and the third conductive pieces bring about a power input while the second conductive piece brings about a power output. The diode is connected with the first and the third conductive pieces.

6 Claims, 6 Drawing Sheets

THREE-WAY SWITCH

FIELD OF THE INVENTION

The present invention relates generally to a switch, and more particularly to a three-way switch capable of operating in three ways.

BACKGROUND OF THE INVENTION

As shown in FIG. 1, a three-way switch of the prior art comprises a base 10, three conducting pieces 19, 20 and 21, and one diode 24.

The base 10 is provided in the underside thereof with a receiving portion 12, an armature member 14 arranged in the base 10, and a conductive bridging member 15 arranged on the armature member 14 such that the armature member 14 has two bridging portions 16 and 17, and an insulation portion 18. The three conducting pieces 19, 20 and 21 are housed in the base 10 such that they are connected with the bridging portions 16, 17, and the insulation portion 18. The second and the third conducting pieces 20 and 21 are provided respectively with a connection portion 22, which is received in a slot 101 of the base 10. The diode 24 is located in the receiving portion 12 of the base 10 such that both ends of the diode 24 are engaged with the connection portions 22 so as to keep the second and the third conducting pieces 20 and 21 in the "ON" state. The three-way switch of the prior art is thus capable of operating in three ways, such as "high", "low", and "off".

The prior art switch described above has shortcomings, which are expounded explicitly hereinafter.

The base 10 is relatively large in size to accommodate the diode 24 in the receiving portion 12 and is therefore not cost-effective.

The prior art switch is defective in design in that the component parts are located scatteringly in the base 10 and can not be therefore assembled efficiently. For example, the diode 24 is located in the underside of the base 10 while the connecting pieces 20 and 21 are located in the upper side of the base 10. As a result, the task of connecting the diode 24 and the connecting pieces 20 and 21 is rather time-consuming. In addition, the base 10 is provided with two slots 101 for accommodating the connecting pieces 20 and 21, thereby resulting in an increase in the cost of making the base 10.

SUMMARY OF THE INVENTION

The primary objective of the present invention is to provide a three-way switch which is free from the shortcomings of the three-way switch of the prior art.

In keeping with the principle of the present invention, the foregoing objective of the present invention is attained by the three-way switch which is composed of a base, an armature member, at least three conductive pieces, and a diode. The base has a receiving space for locating the armature member and a bridging member engaged with the armature member. The three conductive pieces are located in the receiving space of the base such that they are in contact with the periphery of the armature member. The first and the third conductive pieces are intended for the input while the second conductive piece is used for the output. The diode is located in the receiving space of the base such that the diode is connected with the first and the third conductive pieces.

The foregoing objective, features, functions, and advantages of the present invention will be more readily understood upon a thoughtful deliberation of the following detailed description of the embodiments of the present invention in conjunction with the accompanying drawings.

DETAILED DESCRIPTION OF THE INVENTION

Figure 1:
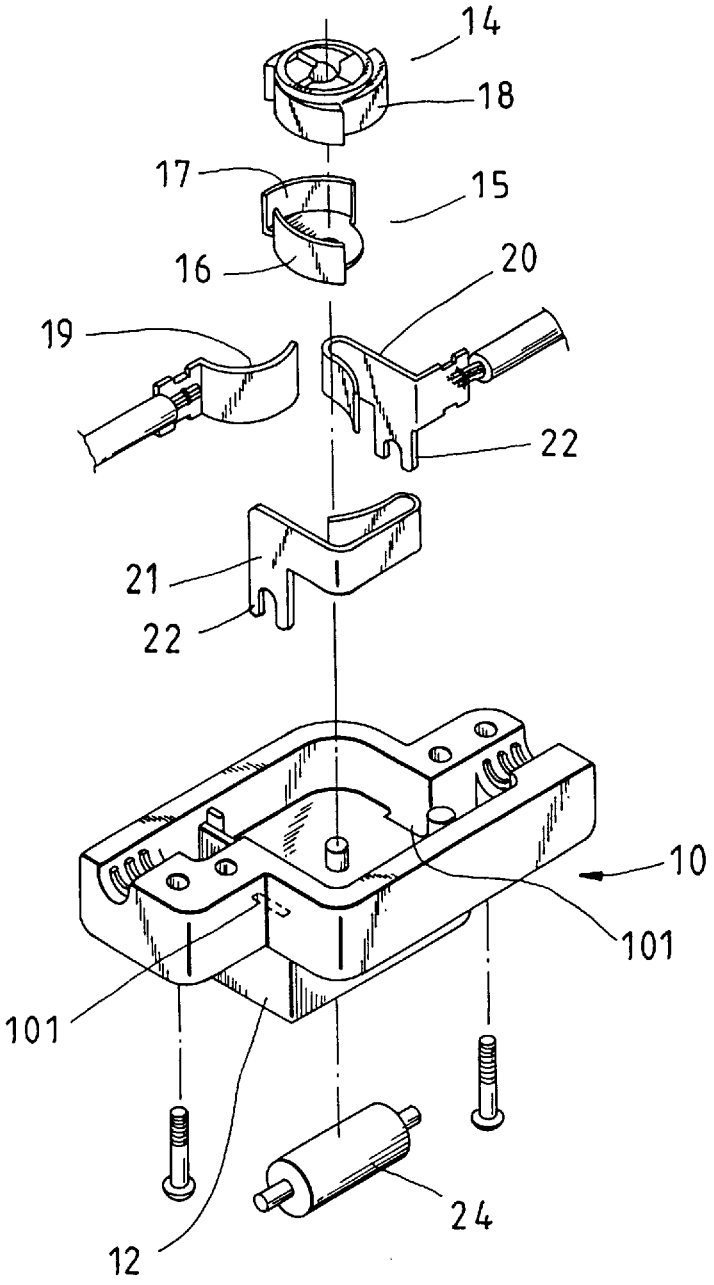
FIG. 1 PRIOR ART
FIG. 1 shows an exploded view of a three-way switch of the prior art.
Figure 2:
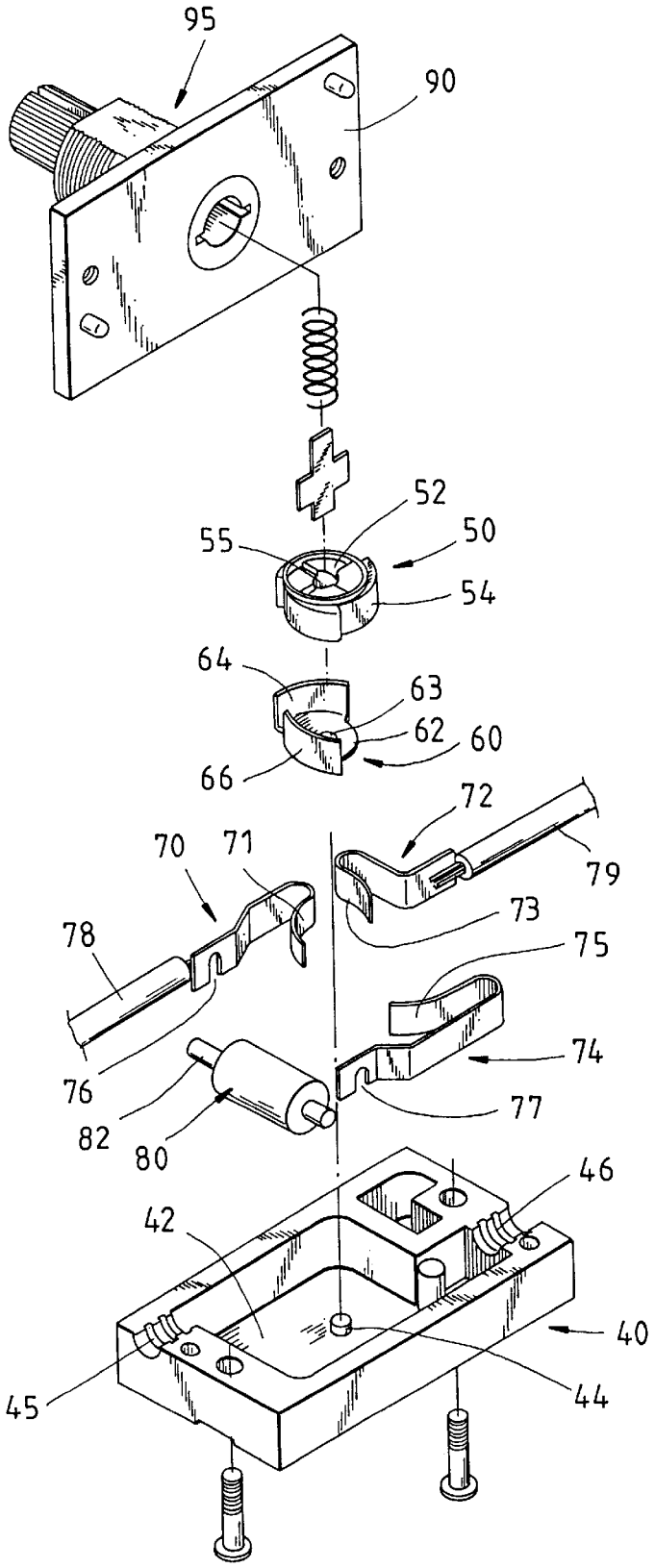
FIG. 2 shows an exploded view of a first preferred embodiment of the present invention.
Figure 3:
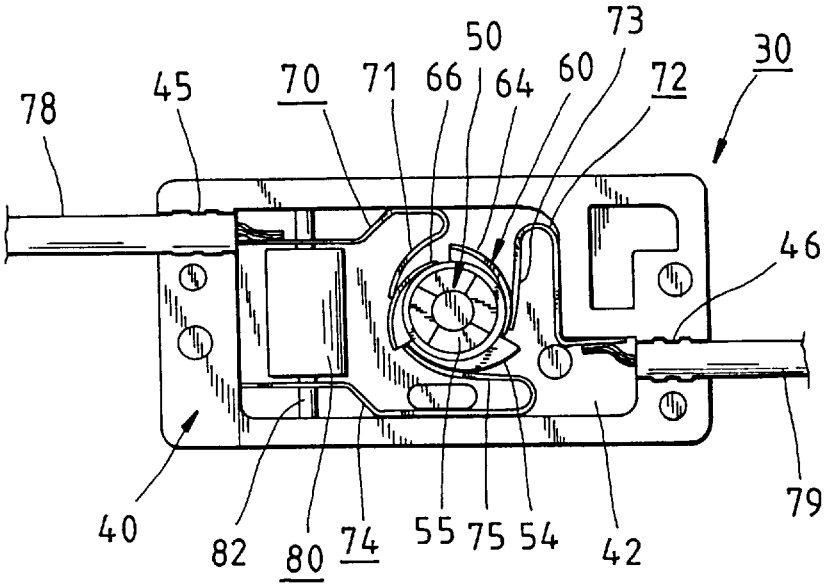
FIGS. 3–5 are top plan views illustrating the operation of the first preferred embodiment of the present invention.
Figure 4:
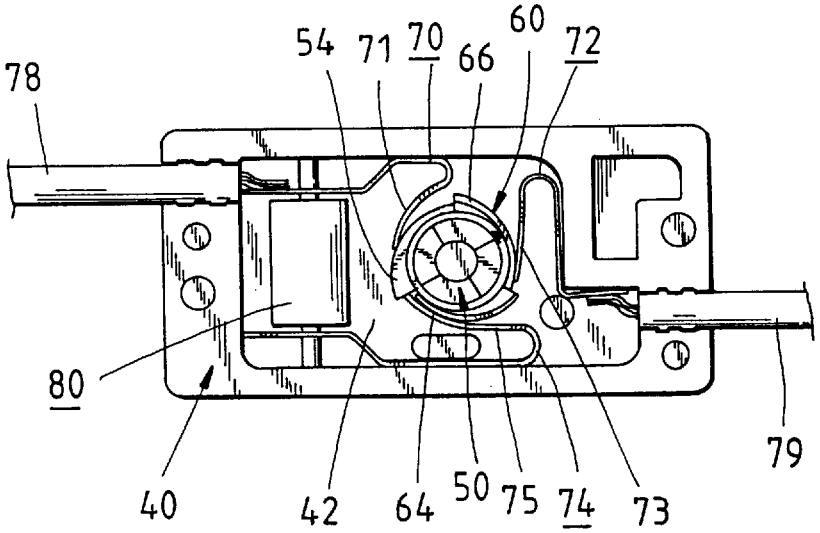
Figure 5:
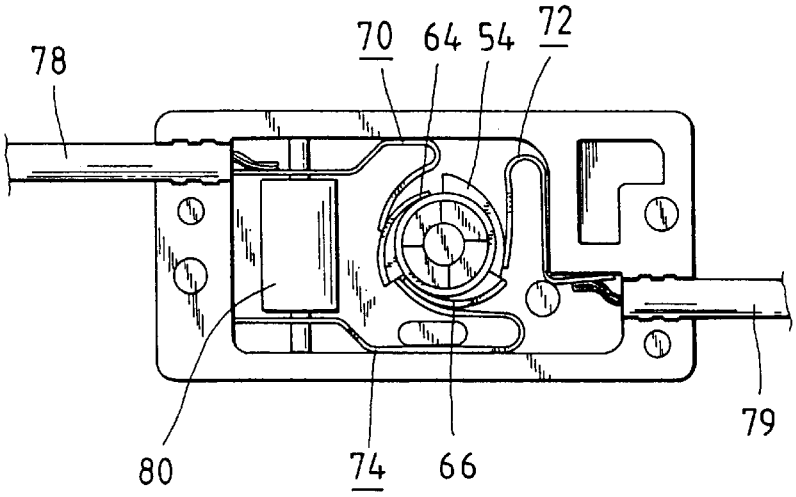
Figure 7:
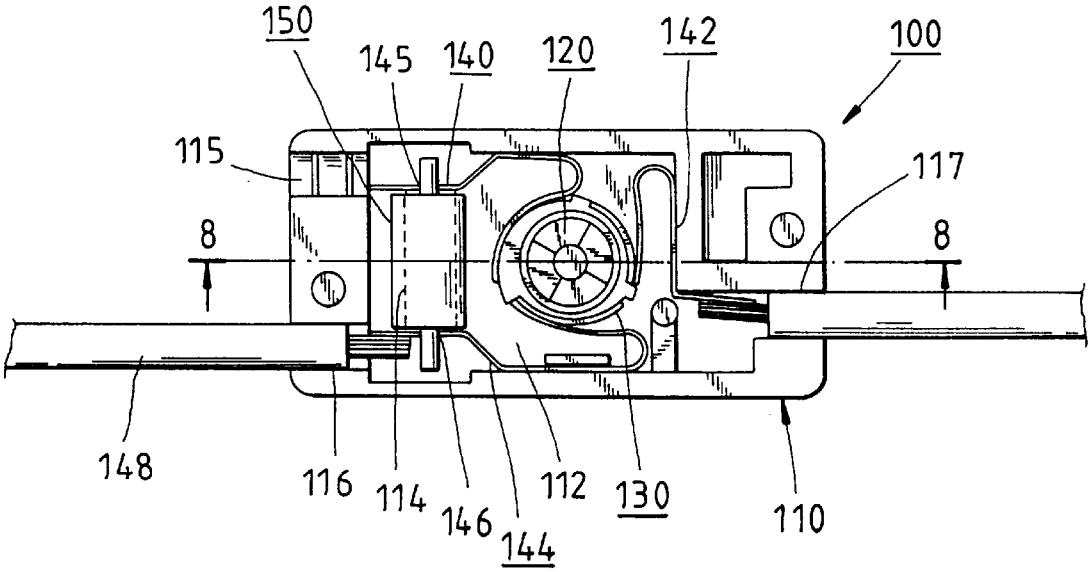
FIG. 7 shows a top plan view of the second preferred embodiment in combination according to the present invention.

As shown in FIGS. 2 and 3, a three-way switch 30 of the first preferred embodiment of the present invention comprises the component parts, which are described explicitly hereinafter.

A base 40 is provided therein with a receiving space 42 having an open top and a column 44 located in the bottom wall of the receiving space 42. Located in two opposite short side walls of the rectangular base 40 are two wire slots 45 and 46, which are in communication with the receiving space 42.

An armature member 50 has a toothed periphery which is provided with three ratchet teeth. Located in the top of the armature member 50 is a drive portion 52.

A bridging member 60 has a bottom 62 and two bridging portions 64 and 66 extending from the periphery of the bridging member 60 such that the periphery of the bridging member 60 is divided into three equal parts by the bridging portions 64, 66 and a cut located between the two bridging portions 64 and 66. The bridging member 60 is engaged with the armature member 50 such that the bridging portions 64 and 66 are in contact with two ratchet teeth of the armature member 50, and that the bottom 62 is in contact with the bottom of the armature member 50, and further that the third ratchet tooth of the armature member 50 forms an insulation portion 54. The armature member 50 and the bridging member 60 are rotatably located in the receiving space 42 of the base 40 such that a through hole 63 of the bottom 62 of the bridging member 60 and an axial hole 55 of the armature member 50 are rotatably fitted over the column 44 of the receiving space 42 of the base 40.

Three conductive pieces 70, 72 and 74 are respectively provided with arcuate contact ends 71, 73, 75. The first and the third conductive pieces 70 and 74 are provided respectively with insertion slots 76, 77. The conductive pieces 70, 72 and 74 are located in the receiving space 42 such that their contact ends 71, 73 and 75 are in contact with the armature member 50, and that the second conductive piece 72 is located in one side of the receiving space 42 to serve as an output conductive piece, and further that the first and the third conductive pieces 70 and 74 are located in another side of the receiving space 42 to serve as input conductive pieces opposite in location to the output conductive piece. The first conductive piece 70 is connected with a wire 78 which is located in the wire slot 45 to serve as a power input end. In the meantime, the second conductive piece 72 is connected with a wire 79 which is located in the wire slot 46 to serve as a power output end.

A diode 80 is located in the receiving space 42 such that both ends 82 of the diode 80 are located in the insertion slots 76 and 77 so as to connect the conductive pieces 70 and 74.

A cap 90 is provided with a rotating member 95. The cap 90 is fastened with the top of the base 40 such that the rotating member 95 is in contact with the drive portion 52 for rotating the armature member 50.

In operation, the first and the second bridging portions 64 and 66 are in contact with the contact ends 71 and 73 of the first and the second conductive pieces 70 and 72 when the present invention is at a first position, as shown in FIG. 3. In the meantime, the insulation portion 54 is in contact with the contact end 75 of the third conductive piece 74 to prevent the electric current from flowing through the third conductive piece 74. The input of power takes place at the wire 78 through which the power is transmitted to the second bridging portion 66 via the first conductive piece 70. The power is then transmitted to the first bridging portion 64 via the bottom 62 of the bridging member 60. The output of power takes place via the second conductive piece 72 and the wire 79 without the power voltage being lowered by the diode 80.

As the rotating member 75 is rotated to actuate the armature member 50 to turn clockwise to be at a second position, the insulation portion 54 is in contact with the first conductive piece 70. In the meantime, the bridging portions 64 and 66 are respectively in contact with the second and the third conductive pieces 72 and 74 to prevent the electric current from flowing through the first conductive piece 72. The third conductive piece 74 serves as a current shunt. A half-power output of current is attained when the current is transmitted to the second conductive piece 72 via the diode 80, the third conductive piece 74 and the bridging portions 64 and 66.

As the armature member 50 is further rotated clockwise to be at a subsequent position, the insulation portion 54 is in contact with the second conductive piece 72. In the meantime, the bridging portions 64 and 66 are respectively in contact with the first and the third conductive pieces 70 and 74. As a result, the power output does not take place via the wire 79 to result in the "OFF" state.

If the armature member 50 is further rotated to return to its original position as shown in FIG. 3. The armature member 50 can be thus rotated once again in series to bring about the full-power output, the half-power output, and the "OFF" state.

The size of the switch of the present invention is reduced significantly, thanks to the base 40 provided with the receiving space 42 in which the diode 80 is mounted. The reduction in size of the switch of the present invention results in the realization of the cost-effectiveness. Moreover, the assembly of the switch of the present invention is relatively simplified in view of the fact that all component parts are mounted on the base 40. The cost of preparing the molding tool is reduced accordingly.

Figure 6:
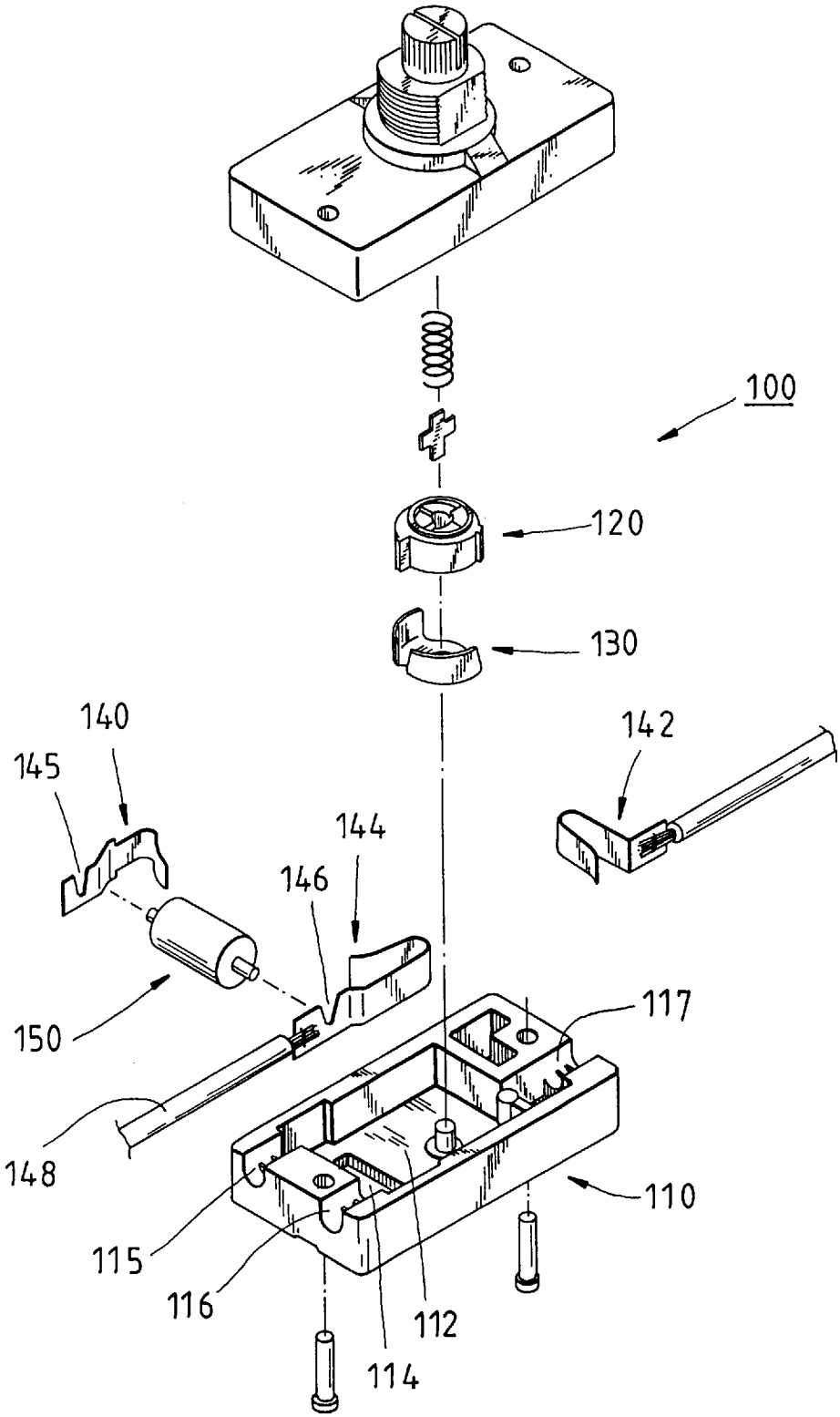
FIG. 6 shows an exploded view of a second preferred embodiment of the present invention.
Figure 8:
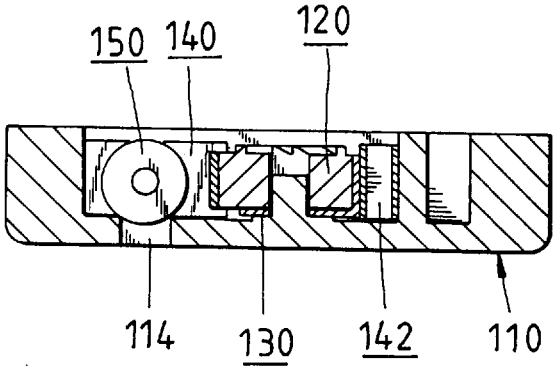
FIG. 8 shows a sectional view taken along the direction of a line 8—8 as shown in FIG. 7.

As illustrated in FIG. 6, a switch 100 of the second preferred embodiment of the present invention is composed of a base 110 provided with a receiving space 112, an armature member 120, a bridging conductive piece 130, three conductive pieces 140, 142, 144, and a diode 150. The switch 100 of the second preferred embodiment of the present invention is different from the switch 30 of the first preferred embodiment of the present invention in that the former has the receiving space 112 which is provided in the bottom wall thereof with a vent 114 for dispersing the heat, and that the former has the base 110 which is provided in one side thereof with two wire slots 115 and 116, and in another side thereof with one wire slot 117. In addition, the bottom of the diode 150 of the switch 100 of the second preferred embodiment of the present invention is received in the vent 114 such that the space occupied by the diode 150 in the receiving space 112 is reduced, as shown in FIG. 8.

The wire 148 may be arranged according to the first preferred embodiment described above such that the wire 148 is connected with the first conductive piece 140. The wire 148 may be also located in the wire slot 116 such that the wire 148 is connected with the third conductive piece 144, and that the third conductive piece 144 serves as a current shunt, with the voltage being lowered via the diode 150. The wire 148 may be located in the wire slot 115 or 116 to facilitate the mounting of the switch of the present invention in the various electric appliances.

Figure 9:
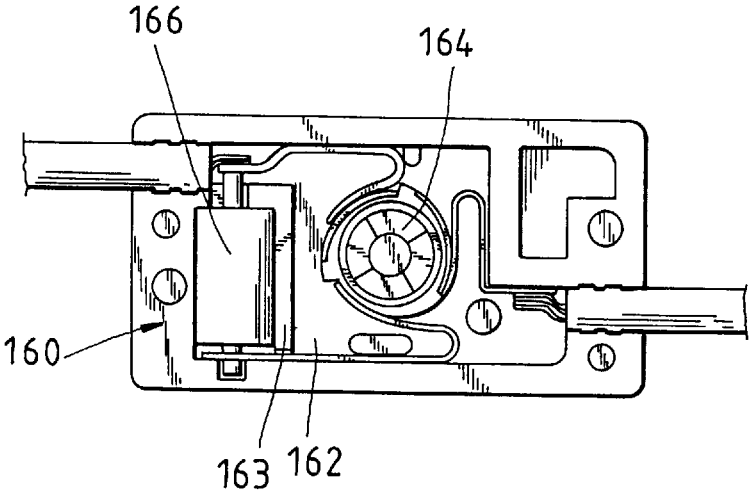
FIG. 9 shows a top plan view of a third preferred embodiment of the present invention.

As shown in FIG. 9, a switch of the third preferred embodiment of the present invention is different from the first and the second preferred embodiments of the present invention in that the former comprises a base 160 provided with a receiving space 162 having a rib 163 which is located between an armature member 164 and a diode 166.

What is claimed is:

1. A three-way switch comprising:

a base provided in an interior thereof with a receiving space, in one side thereof with a wire slot in communication with said receiving space, and in another side thereof with a wire slot in communication with said receiving space;

an armature member;

a bridging conductive member fastened with said armature member such that said armature member is provided with a plurality of bridging portions and an insulation portion, and that said bridging member and said armature member are rotatably located in said receiving space of said base;

at least three conductive pieces each having a contact end, said conductive pieces located in said receiving space of said base such that contact ends of said conductive pieces are in contact with said bridging portions and said insulation portion, and that first and second of said three conductive pieces serve to bring about a power input, and that third of said three conductive pieces serves to bring about a power output;

an input wire connected with said power input such that said input wire is located in said wire slot located in said one side of said base;

an output wire connected with said power output such that said output wire is located in said wire slot located in said another side of said base; and a diode mounted in said base for lowering power voltage;

wherein said diode is mounted in said receiving space of said base such that said diode is connected with said first and second conductive pieces; wherein said receiving space is provided in a bottom wall thereof with a vent; and wherein said diode is received at a bottom end thereof in said vent.

2. The three-way switch as defined in claim 1, wherein said two of said three conductive pieces are provided respectively with a slot for engaging said diode.

3. The three-way switch as defined in claim 1, wherein said diode is provided with two slots for engaging said first and second conductive pieces.

4. The three-way switch as defined in claim 1, wherein said base is provided in one side thereof with at least two wire slots corresponding in location to said first and second conductive pieces; and wherein said input wire is located in a wire slot such that said input wire is connected with said third conductive piece.

5. The three-way switch as defined in claim 1, wherein said base is provided in one side thereof with at least two wire slots corresponding in location to said first and second conductive pieces; and wherein said input wire is located in a wire slot such that said input wire is connected with said third conductive piece.

6. The three-way switch as defined in claim 1, wherein said receiving space is provided with a rib located between said diode and said amature member.

* * * * *